US008322546B2

(12) United States Patent
Pfenniger et al.

(10) Patent No.: US 8,322,546 B2
(45) Date of Patent: Dec. 4, 2012

(54) TEAT UNIT

(75) Inventors: Erich Pfenniger, Ebikon (CH); Peter Vischer, Küssnacht am Rigi (CH); Mario Rigert, Buchrain (CH); Leon Mitoulas, Cham (CH)

(73) Assignee: Medela Holding AG, Baar (CH)

( * ) Notice: Subject to any disclaimer, the term of this patent is extended or adjusted under 35 U.S.C. 154(b) by 504 days.

(21) Appl. No.: 12/483,101

(22) Filed: Jun. 11, 2009

(65) Prior Publication Data

US 2009/0321377 A1 Dec. 31, 2009

(30) Foreign Application Priority Data

Jun. 12, 2008 (CH) ..... 0897/08
Feb. 6, 2009 (CH) ..... 0174/09

(51) Int. Cl.
*A61J 9/00* (2006.01)
*B65D 51/16* (2006.01)

(52) U.S. Cl. ..... 215/11.4; 215/311

(58) Field of Classification Search ..... 215/11.4, 215/43, 311; 220/203.29, 203.19, 203.18, 220/203.16, 203.11, 203.01; 222/544; D9/449; *A61J 9/00, 11/04*

See application file for complete search history.

(56) References Cited

U.S. PATENT DOCUMENTS 981,072 A * 1/1911 Decker ..... 215/11.1
1,569,693 A 1/1926 Young
2,597,483 A * 5/1952 Head, Sr. ..... 137/533.29
2,734,665 A * 2/1956 Flamm ..... 222/207
2,774,500 A * 12/1956 Budiani ..... 215/11.1
2,812,764 A * 11/1957 Crisp ..... 215/11.1
3,207,349 A 9/1965 Rabe
3,650,270 A 3/1972 Frazier
4,993,568 A * 2/1991 Morifuji et al. ..... 215/11.1
5,704,505 A 1/1998 Singh

FOREIGN PATENT DOCUMENTS

| | | | |
|---|---|---|---|
| GB | 347368 | | 4/1931 |
| GB | 2169210 | A * | 7/1986 |
| GB | 2226014 | | 6/1990 |
| WO | 99/22693 | A1 | 5/1999 |
| WO | 02/100320 | A1 | 12/2002 |
| WO | 2004/002276 | A1 | 1/2004 |
| WO | 2006/000816 | A1 | 1/2006 |
| WO | 2007/053894 | A1 | 5/2007 |

* cited by examiner

*Primary Examiner* — Mickey Yu
*Assistant Examiner* — Robert J Hicks
(74) *Attorney, Agent, or Firm* — McDonnell Boehnen Hulbert & Berghoff LLP

(57) ABSTRACT

A teat unit for sucking a liquid from a liquid container includes a teat and a flow restrictor with a through-opening. The teat comprises a mouthpiece, with a suction opening, and a main body which is formed integrally on the mouthpiece and widens relative to the mouthpiece. The flow restrictor defines a maximum flow of the liquid passing through the suction opening from the liquid container. According to the invention, the flow restrictor is arranged outside the mouthpiece, and the suction opening has a greater cross-sectional surface area than the through-opening of the flow restrictor. The teat unit permits a feeding action that is as true to nature as possible, since the mouthpiece can be deformed very considerably, without substantially impairing the flow restriction.

15 Claims, 5 Drawing Sheets

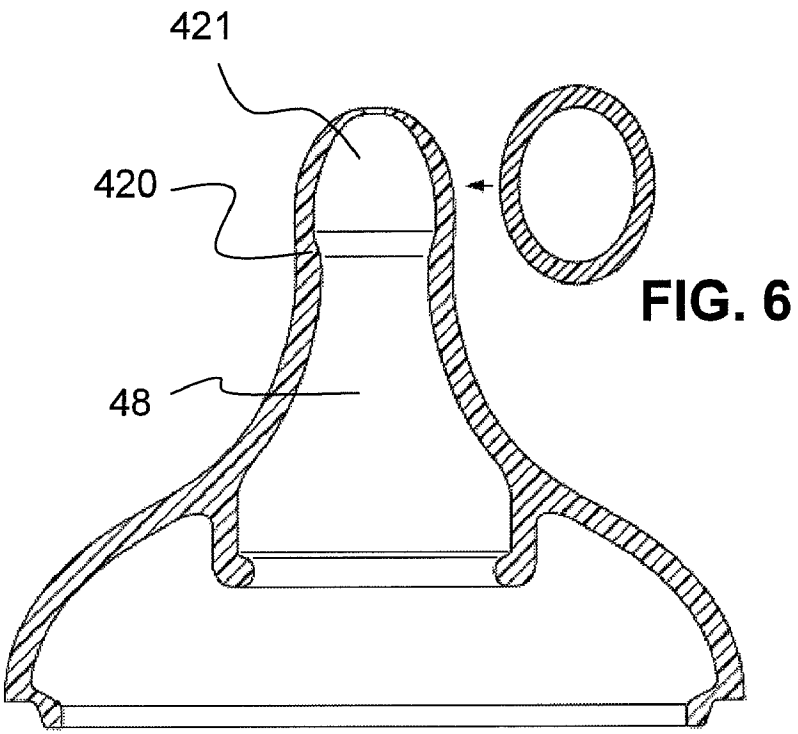
FIG. 6
FIG. 5
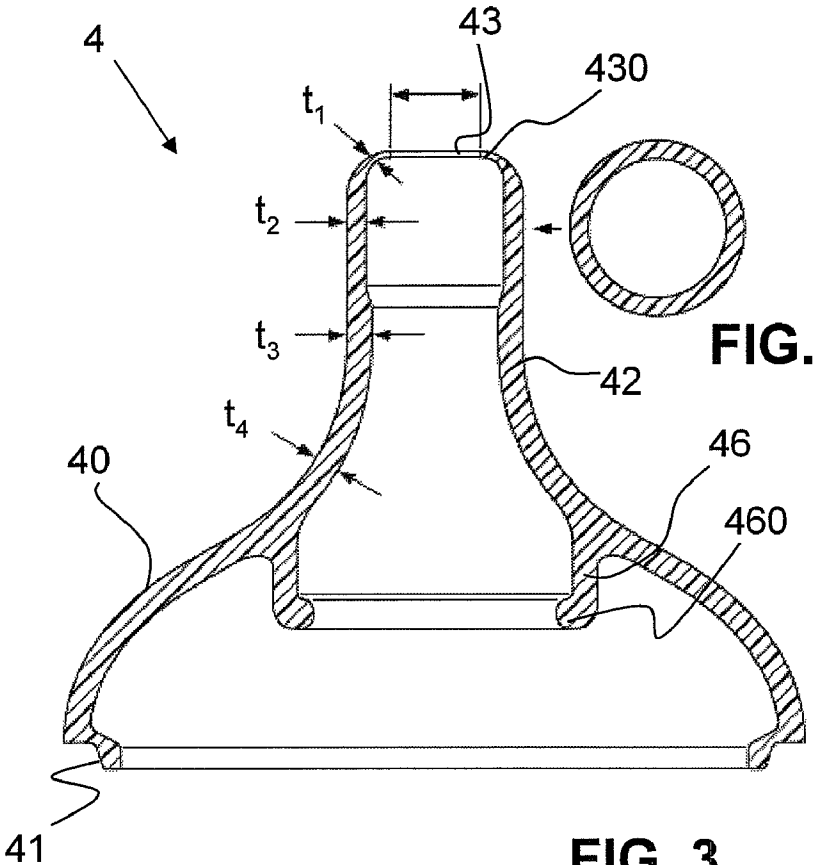
FIG. 4
FIG. 3

TEAT UNIT

CROSS-REFERENCE TO RELATED APPLICATIONS

This application claims priority to Swiss Patent Application No. 00897/08 filed Jun. 12, 2008. This application also claims priority to Swiss Patent Application No. 00174/09 filed Feb. 6, 2009. The entire disclosure content of these applications are herewith incorporated by reference into the present application.

BACKGROUND OF THE INVENTION

The invention relates to a teat unit.

A baby ideally suckles from its mother's breast. However, there are various reasons why this is not always possible. For many years now, attempts have therefore been made to develop teats for feeding bottles that allow the baby to feed as naturally as possible. The baby should be able to switch back and forth between the mother's breast and a feeding bottle as far as possible without confusion. Importance is attached to, among other things, the baby not being able to accidentally interrupt the flow of milk by pressing the mouthpiece of the teat too strongly together. In the early stages of the development of teats, another main aim was to ensure that the teat does not cause any lasting damage in the baby's mouth. Another aim is to ensure that a baby who feeds too eagerly does not choke. The prior art therefore proposes either using small suction openings or flow restrictors.

EP 1 532 957 discloses, for example, a teat with a large suction opening and with a flow restrictor arranged in the mouthpiece. In U.S. Pat. No. 5,101,991 and BE 381523 also, the flow restrictors protrude into the mouthpiece.

EP 0 384 394 describes a teat with a first flow restrictor having a large opening, and with a suction opening as second flow restrictor with a smaller cross section.

In WO 99/22693, a teat with a valve is present, but without a flow restrictor of defined cross-sectional surface area.

WO 2007/137440, WO 2007/137436 and WO 2007/137885 disclose relatively stiff mouthpieces that are only minimally deformable.

WO 03/013419 describes a relatively small suction opening and a larger through-opening outside the mouthpiece. The through-opening is in this case provided with a nonreturn one-way valve.

U.S. Pat. No. 5,791,503 discloses a relatively complex teat unit with a nonreturn valve.

SUMMARY OF THE INVENTION

It is therefore an object of the invention to create a teat unit that permits a feeding action as true to nature as possible.

This object is achieved by a teat unit having the features of the claims appended hereto.

The teat unit according to an aspect of the invention for sucking a liquid from a liquid container comprises a teat and a flow restrictor with a through-opening. The teat comprises a mouthpiece with a suction opening from which liquid emerges from the mouthpiece, and a main body which is preferably formed integrally with the mouthpiece, and widens relative to the mouthpiece. The flow restrictor defines a maximum flow of the liquid passing through the suction opening from the liquid container. According to the invention, the flow restrictor is arranged outside the mouthpiece, and the suction opening has a greater cross-sectional surface area than the through-opening of the flow restrictor.

By virtue of the large opening, the mouthpiece, (also called the nipple), is able to deform easily during feeding and adapts optimally to the movements of the baby's mouth and tongue. The baby has a sensation in its mouth similar to the sensation when feeding on the natural nipple of a mother's breast. The mouthpiece is flexible and, during its intended use, there are preferably no parts protruding into and stiffening the mouthpiece along a substantial part of its length. The mouthpiece is therefore preferably deformable during its intended use.

A milk channel is preferably present between suction opening and flow restrictor and also has a diameter that is at least as great as the diameter of the suction opening. If several milk channels are present, they have at least along their entire length a common discharge opening which is greater than that of the flow restrictor and which preferably corresponds at least to the diameter of the suction opening. The inner diameter of the milk channel has preferably approximately the same size over its entire length as the suction opening. In the area between the flow restrictor and the suction opening, no further flow restriction is present restricting the flow to a larger extent, or only nearly as much as the first named flow restrictor.

Preferably, however, only a single milk channel is present in the mouthpiece, such that the mouthpiece is as flexible as possible.

The entire cross-sectional area of the suction opening is in an aspect of the invention many times as large as the entire cross-sectional area of the flow opening of the flow restrictor. Typical diameters are 3 to 8 mm for the suction opening and 0.2 to 0.7 mm for the flow restrictor.

The mouthpiece can have the same softness and flexibility along its entire length. In a preferred illustrative embodiment, however, it becomes harder and/or stiffer towards the main body. Depending on the design, this is done continuously or in stages. This change can be effected by increasing the wall thickness, for example.

The suction opening and/or the adjoining milk channel can have a round, oval or elliptic cross section. They can be made rotationally symmetrical or with mirror symmetry. However, they can also have an asymmetrical shape. The same applies to the outer shape of the mouthpiece. For example, it can have a round cross section along its entire length or in particular can have a dental form.

The flow restrictor can be formed in the teat itself or can be located in a separate part of the teat unit. However, the flow restrictor is arranged outside the mouthpiece, i.e. outside the part taken into the baby's mouth during the intended use. In this way, the baby is unable to influence the flow restrictor by means of mechanical pressure or pulling, caused by movements of its lips and mouth.

The teat unit according to a preferred form of the invention thus separates the following functions:

- adaptation and deformation of the mouthpiece in a manner that is as true to nature as possible,
- flow restriction, to ensure that the baby does not choke.

It is a further object of the invention to create a teat unit that permits a feeding action as true to nature as possible even when a valve is used in the teat unit.

This object is achieved by a teat unit for sucking a liquid from a liquid container having a teat and a flow restrictor with a through-opening. The teat comprises a mouthpiece with a suction opening, and a main body which is formed integrally with the mouthpiece and widens relative to the mouthpiece. The flow restrictor defines a maximum flow of the liquid passing through the suction opening from the liquid container. According to the invention, the flow restrictor is arranged outside the mouthpiece, and the teat unit has a one-way valve which is arranged outside the mouthpiece, wherein the flow restrictor is arranged in the one-way valve or in an area adjacent thereto. A large suction opening is of advantage here too, but is not absolutely essential. The mouthpiece can in this case also have reinforcing elements, for example ribs. However, it is preferably designed as a single wall and/or unreinforced.

Only atmospheric pressure or underpressure prevails in this teat unit. No overpressure develops. Therefore, the milk does not squirt into the baby's mouth, and instead it flows into the mouth in accordance with the vacuum applied by the baby. The flow of milk is thus more or less proportional to the vacuum applied by the baby.

This teat unit permits feeding which is controlled purely by vacuum and is largely independent of the other movement, in particular the peristaltic movement, of the tongue. When the rear area of the tongue moves towards the upper palate, no milk should be able to flow. When this rear area moves away from the upper palate, the milk then flows.

The teat unit according to the invention makes use of the knowledge that the baby does not switch back and forth between vacuum and atmospheric pressure during feeding. Rather, it maintains a basic vacuum throughout the entire feeding process. In contrast to the arrangements according to the prior art, the valve now closes when this basic vacuum is reached. When the absolute value of the applied vacuum rises above this basic vacuum, the valve opens and the milk or liquid is able to flow. Despite maintaining the basic vacuum, the baby is thus able to pause, catch its breath, or take a rest and gather renewed strength, which is also what happens at the mother's breast. The device according to the invention preferably already opens at a slight underpressure of from 1 to 90 mmHg, preferably 20 to 70 mmHg. More preferred values are between 20 and 30 mmHg and between 5 and 30 mmHg. In absolute terms, these values are just above a typical basic vacuum applied by a baby.

However, during feeding, the valve has no further influence on the flow of milk. The degree of opening and mode of operation of the valve do not influence the flow of milk through the suction opening.

Since the nonreturn valve and the flow restrictor are arranged outside the mouthpiece, any deformation of the mouthpiece does not influence the function of the non-return valve. The baby is therefore unable to exert any influence on the nonreturn valve by mechanical pressure and/or pulling.

In a first embodiment, the nonreturn valve covers the through-opening of the flow restrictor. In a preferred embodiment, however, the nonreturn valve does not cover the relatively small through-opening of the flow restrictor but instead a larger opening. This opening is preferably arranged upstream of the flow restrictor in the direction of flow of the liquid, i.e. directed towards the liquid container. However, it can also be arranged downstream of the flow restrictor in the direction of flow.

In other embodiments not shown here, the opening of the flow restrictor is located in the stiff valve seat, i.e. here in the base part. This opening can in this case be covered and closed by the valve diaphragm. However, it can also be arranged adjacent thereto and lead into the dead volume.

In another embodiment, the opening of the flow restrictor can be arranged in the valve diaphragm and can be closed by means of the diaphragm bearing sealingly on the valve seat. In this case, the discharge opening is arranged adjacent thereto in the valve seat and is not closed by the diaphragm but instead leads into the dead volume. The discharge opening can be the same size as or larger than the opening of the flow restrictor.

The flow restrictor can thus be arranged in, over or under the valve diaphragm.

Since the valve and the flow restrictor, or the discharge opening and the valve, are arranged adjacent to each other, this minimizes the dead volume in which a vacuum likewise has to be generated. The valve or the teat also functions perfectly at low flow rates.

Preferably, the valve is easily detachable and the teat unit is therefore easy to clean. If a diaphragm is used, it can be held by clamping it between individual parts.

Instead of a diaphragm clamped in place with or without a well-defined opening cross section, it is also possible to use a screen valve, a spout valve or a slotted diaphragm.

In a preferred embodiment, the suction opening has a greater cross-sectional surface area than the through-opening of the flow restrictor. The milk channel between flow restrictor and suction opening preferably has a cross-sectional surface area along its entire length which is greater than that of the through-opening and preferably corresponds at least to the size of the cross-sectional surface area of the suction opening. Alternatively, in combination with the nonreturn valve, the suction opening can also have the same size of cross-sectional surface area as the flow restrictor. The same applies to the milk channel.

Further advantageous embodiments are set forth in the dependent claims. In particular, the features of the dependent claims can also be implemented without the feature of the large suction opening in the teat unit according to claim 13.

BRIEF DESCRIPTION OF THE SEVERAL VIEWS OF THE DRAWINGS

The subject matter of the invention is explained below on the basis of a preferred illustrative embodiment depicted in the attached drawings, in which:

FIG. 3 shows a longitudinal section through the teat according to FIG. 1 when not in use;

FIG. 4 shows a cross section, perpendicular to the longitudinal axis of the teat, through an upper area of the teat according to FIG. 3;

FIG. 5 shows a longitudinal section through the teat according to FIG. 1 during its intended use;

FIG. 6 shows a cross section, perpendicular to the longitudinal axis of the teat, through an upper area of the teat according to FIG. 5;

DETAILED DESCRIPTION OF THE INVENTION

A preferred illustrative embodiment of the teat unit according to the invention is depicted in FIGS. 1 to 6.

Figure 1:
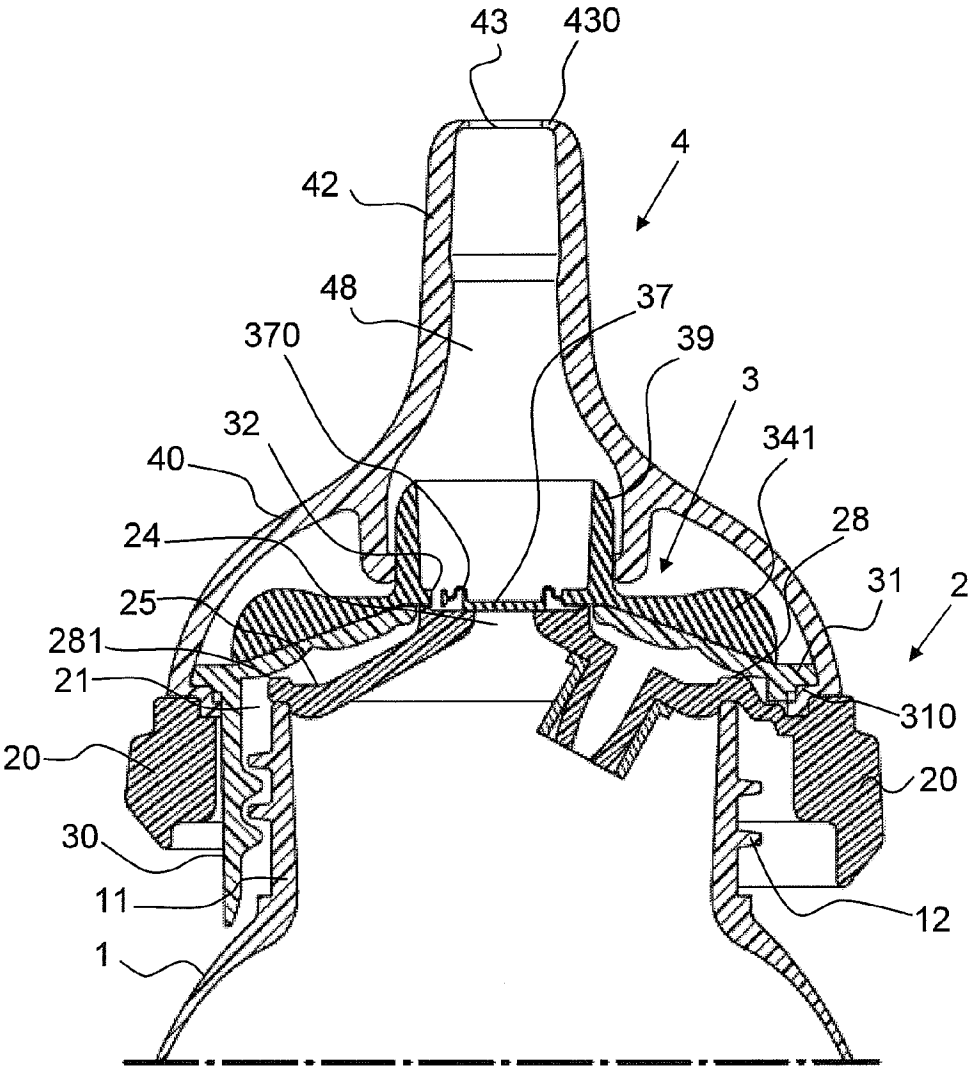
FIG. 1 shows a longitudinal section through a teat unit according to the invention in a first embodiment and with the valve closed.
Figure 2:
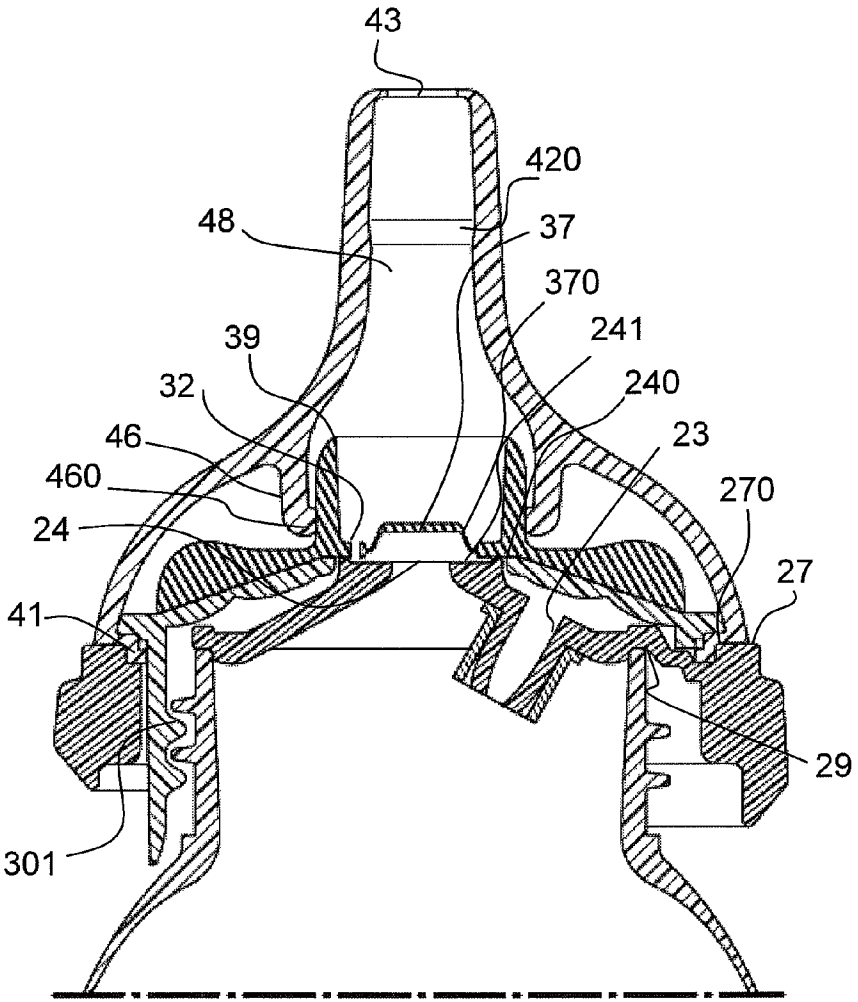
FIG. 2 shows the teat unit according to FIG. 1 with the valve opened.

A teat unit 2, 3, 4 according to the invention is screwed onto an externally threaded neck 11 of a baby's feeding bottle 1 or of another liquid container (FIGS. 1 and 2). The teat unit 2, 3, 4 is composed principally of three parts: a base part 2, a receiving head 3 and a suction body or teat 4. The base part 2 is preferably made of polypropylene (PP) or a polyamide, while the receiving head 3 is made of a combination of PP or a polyamide with silicone, rubber or TPE. For the teat 4, silicone, a silicone-based plastic, rubber or TPE is preferably used.

The base part 2 is dimensionally stable (generally rigid). It is composed principally of an annular body 20 and of a truncated cone 25 formed integrally on the latter. Centrally in the truncated cone 25, there is a discharge opening 24 which serves as the inlet opening of the unit and which connects the interior of the container 1 to the outside, i.e. to the teat. The truncated cone 25 protrudes above the annular body 20 and extends upwards towards the receiving head 3. The discharge opening 24 is preferably arranged in the uppermost area, preferably in the flattened tip. This tip has an upper sealing edge 240. In the interior of this sealing edge 240, arranged around the discharge opening 24, there is a plane surface 241.

On the top of the base part 2 directed away from the container neck 11, there is an upwardly protruding circumferential outer sealing edge 27. The latter is preferably formed by the uppermost circumferential edge of the annular body 20. It is followed in the radially inward direction by a circumferential, plane and recessed outer sealing surface 270.

Adjoining or at a distance from the outer sealing surface 270, there is an inner circumferential sealing edge 28, which likewise protrudes upwards. The sealing edge 28 is preferably interrupted by at least one vent opening 281, which leads to the outside. The route to the outside can lead, for example, through a non-tight threaded connection with the feeding bottle 1. A venting valve or a vent opening 23 is preferably arranged in a flank of the inner truncated cone 25.

The base part 2 can be fitted onto the container neck 11, but without already being positionally fixed relative to the latter, in particular secured against rotation. A lower abutment 29 is present which limits how far the container neck 11 can pass through the base part 2, i.e. how far the base part 2 can slip down on the container neck 11. In the examples shown here, the abutment is an inner contact surface 29 in the upper area of the base part 2. Other types of abutments 29 are also possible, for example projecting lugs or ribs.

The receiving head 3 is also annular and preferably rotationally symmetrical. The receiving head 3 is composed principally of two areas. The lower area is formed here by several plug elements 30 which form sections of a common jacket that are distributed uniformly about the circumference. The plug elements 30 form a common inner thread 301 on their inner face. Instead of an inner thread, an outer thread can also be present if the drink container 1 is provided with a corresponding inner thread.

The plug elements 30 can be plugged into slits or slots 21 of the base part 2. Locking ribs on the base part and on the receiving head prevent the receiving head 3 from falling out of the base part.

The upper area of the receiving head 3 is preferably made of a softer material than the lower area. It can be of any desired configuration in the peripheral area. It preferably has peripheral supporting bodies or supporting structures, here supporting cushions 341, which interact with the suction body or teat 4 described below. These supporting structures can also be made of a hard material.

The receiving head 3 has a protruding circumferential securing edge 31 with a peripheral outer sealing surface 310. It is plane and extends approximately perpendicular to the longitudinal centre axis of the receiving head 3.

A closed valve diaphragm 37 is formed integrally on the receiving head 3. It covers the discharge opening 24 of the base part 2. In its peripheral area, which no longer covers the discharge opening 24, the valve diaphragm 37 has a small opening, namely the through-opening 32. This through-opening 32 is located over the inner surface 241 of the base part 2.

The valve diaphragm 37 is preferably formed in one piece on the receiving head 3. It is made of a soft material, and the rest of the head 3 is made of a hard material. However, it can for example also be made in one piece with soft supporting structures 341 and adhesively bonded on the hard part of the receiving head 3, welded to the latter or injection-moulded on it.

The valve diaphragm 37 is surrounded by an upright and circumferential collar 39, which can likewise be made from hard or soft material and in one piece with the rest of the receiving head 3. This collar 39 preferably has circumferential outer ribs, which are not shown here.

The teat 4 has a frustoconical, hemispherical or spherical cap-shaped main body 40, and a mouthpiece 42 integrally formed thereon with a liquid channel or milk channel 48. This is also referred to hereinbelow as the suction channel. In its outer circumference, the mouthpiece 42 is tapered relative to the main body 40, or the latter is widened in its outer circumference relative to the mouthpiece. It has a free end. The mouthpiece 42 is preferably designed in a known manner as a hollow cylinder or as a truncated cone. It preferably forms a thin-walled hollow body with an inlet opening and a suction opening 43. It is resiliently and/or flexibly deformable. It is preferably designed with a single wall. Even when it is designed with a double wall, it should be as resilient and flexible as possible, for example by having thin walls. However, the mouthpiece 42 can also be provided with internal structures, for example radial or axial ribs, knobs and indentations.

The suction opening 43 is present in the mouthpiece 42, preferably in the uppermost tip. In the assembled state, this suction opening 43 is connected to the interior of the container via the through-opening 32 and the discharge opening 24, such that the baby is able to take its drink, e.g. tea, water or milk, through this opening. The suction opening 43 is preferably surrounded by a circumferential, inwardly directed flange 430. The latter gives stability to the free end of the mouthpiece 42. Moreover, the outermost edge of the material, being bent inwards, is in this way better protected against mechanical action.

However, a skirt 46, already protruding into the main body 40 and towards the receiving head 3, is present as a continuation of the mouthpiece 42. An inwardly protruding flange 460 is preferably formed integrally on the skirt 46.

The main body 40 has its lower edge bent inwards, such that a radially inwardly directed flange 41 is obtained. The teat 4 is adapted to be pushed with its main body 40 over the receiving head 3. In doing so, the skirt 46 is pushed over the collar 39, such that the flange 460 of the skirt 46 engages behind the rib of the collar and bears sealingly thereon. The flange 41 of the main body 40 engages behind the projecting edge between the upper and lower areas of the receiving head 3 and bears flat and sealingly on the outer sealing surface 310 of the latter.

The teat 4 is in this way adapted to be placed onto the receiving head 3 or partially pushed over the latter. The receiving head 3 can then be plugged into the base part 2. The receiving head 3 is adapted to be plugged into the base part 2 when the latter is free, but also when the latter is already located on the container neck 11. Since the base part 2 is still slightly movable in the axial direction relative to the receiving head 3, the teat 4 can also be pushed over the receiving head 3 only after the receiving head 3 and base part 2 have been plugged together.

By rotating the base part 2 or the receiving head 3 on the container neck 11, the two threads, namely the outer thread 12 and inner thread 301, mesh with each other. The receiving head 3 runs downwards along the thread. The base part is pulled down with it as far as its lower abutment. The base part 2 and the receiving head 3 are now secured on the container 1 and secured against rotation relative to each other. In this way, the outer sealing surface 270 of the base part 2 is now pressed relative to the outer sealing surface 310 of the receiving head 3. They clamp the flange 41 of the teat 4 and thus ensure a liquid-tight and air-tight connection between teat 4, receiving head 3 and base part 2. Depending on the particular design, a differently shaped lower edge 41 of the teat 4 can also be clamped sealingly between the two parts 2, 3.

The valve diaphragm 37 forms a nonreturn valve which is connected to the rest of the receiving head via a ring hinge 370. The through-opening 32 lying outside this ring hinge 370 forms a flow restrictor. This flow restrictor 32 has a smaller cross-sectional surface area than the following areas through which the liquid flows. In particular, the milk channel or central channel 48 and the suction opening 43 have a larger cross-sectional surface area. However, the suction channel 48 can have one or more constrictions spaced apart from the suction opening 43. As can be seen in the Figures, the through-opening 32 and the nonreturn valve 37 are arranged outside the mouthpiece 42.

In FIG. 1, the nonreturn valve 37 is closed. No liquid is able to pass into the teat 4 through the discharge opening 24. The dead volume between discharge opening 24 and through-opening 32 is relatively small.

In FIG. 2, the nonreturn valve 37 is opened and frees the relatively large discharge opening 24. Liquid can pass through this discharge opening 24 to the through-opening 32 and thus into the mouthpiece 42.

The suction opening 43, and in a preferred embodiment also the milk channel 48, preferably has a cross-sectional surface area that is a multiple of the cross-sectional surface area of the through-opening 32. Typically, the cross-sectional surface area of the suction opening 43 is more than 10 times, in particular more than 50 times, and preferably more than 100 times, larger than that of the through-opening 32. Preferably, the whole area of the suction channel 48 extending within the mouthpiece 42 has a cross-sectional surface area that is larger by the abovementioned factors. Typical diameters are about 7 mm for the suction opening 43, with a preferred range of about 3 mm to about 8 mm, and about 0.2 to about 0.7 mm for the through-opening.

The suction opening 43 or the suction channel 48 preferably has a round cross section in the upper area, as can be seen in FIG. 4. Since the mouthpiece 42 is relatively soft, it is deformed during its intended use, and the suction opening 43 or the suction channel 48 in the adjacent area can assume an oval shape, for example, as is shown in FIG. 6.

The mouthpiece 42 can be of any desired shape, provided that it remains flexible and resilient. As can be seen in particular from FIG. 3, the wall of the mouthpiece 42 can increase in thickness towards the head part 3. This increase takes place in stages here. Typical wall thicknesses are: t1 circa 0.5 mm, t2 circa 1.5 mm, t3 and t4 circa 2.0 mm. Other sizes are possible, however. In the mouthpiece 42, there is preferably a tapered area 420 in the internal diameter, such that a deforming hollow space 421 is formed in the area of the suction opening 43. As can be seen from FIGS. 3 to 6, the cross section of this hollow space 421 deforms during the intended use of the teat, the deformation being dependent on the baby and on the feeding action. The hollow space 421 can in particular become longer, but narrower, and change from a round cross section to an oval cross section. The shape of the teat can change during the feeding process.

Further variations of the example depicted here are possible within the teaching according to the invention. Some examples are given below. Both the flow restrictor and also the nonreturn valve are present in this example. However, in a simpler embodiment not shown here, there is no nonreturn valve present, only the through-opening 32 forming the flow restrictor. This through-opening 32 can be arranged centrally or non-centrally in the head part 3. Moreover, several through-openings may be present, as long as they together have a cross-sectional surface area for the throughput of the liquid, this surface area being smaller than the cross-sectional surface area of the suction opening 43. The through-opening serving as flow restrictor can also be arranged in the base part 2.

Instead of the only one through-opening 32, several through-openings can be distributed about the peripheral circumference of the diaphragm. The area around the at least one through-opening can also be made from hard material, and the soft part of the diaphragm can be formed integrally thereon. Moreover, instead of the multi-part teat unit described here, a differently configured teat unit can also be provided with the arrangement, according to the invention, of a large suction opening and of a through-opening set back from the latter. For example, the liquid container can be provided with the discharge opening 24, which is closed by the diaphragm. Moreover, the chosen discharge opening 24 can be so small that it itself forms the through-opening and therefore the flow restrictor. The teat 4 can also be secured in a different way. For example, the skirt 46 can be plugged into the collar 39. Instead of the flange 41 of the main body 40, other securing means can also be chosen. For example, the teat can be in direct contact with the liquid container. The teaching according to the invention can also be used, for example, on the teats mentioned in the introduction, for example according to EP 1 532 957.

Figure 8:
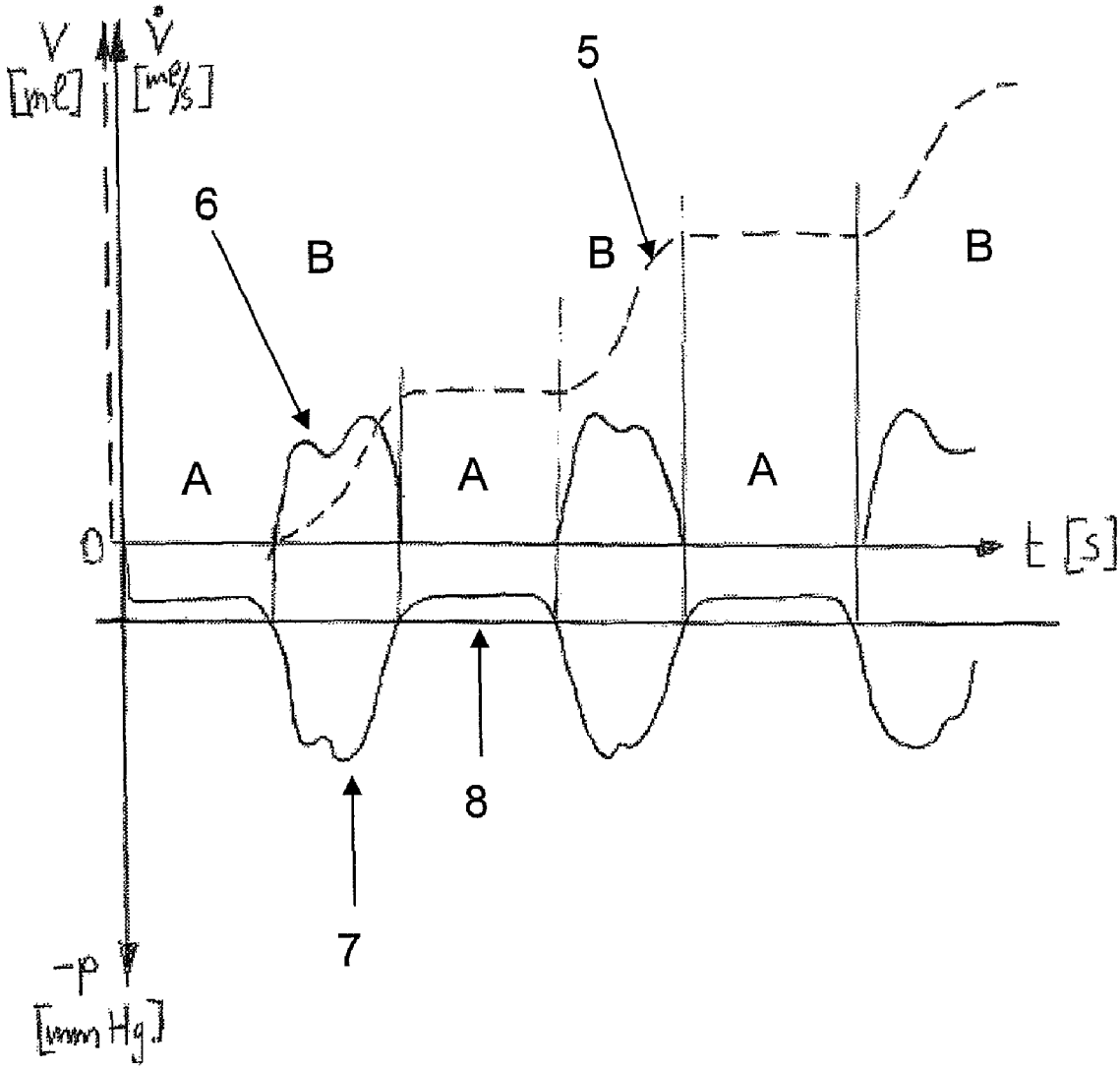
FIG. 8 shows a graphic representation of the mode of operation of the valve according to the invention depending on the feeding action of a baby.

The mode of operation of the device according to the invention can be seen from FIG. 8. The volume 5, i.e. the integral of the volumetric flow curve, of the sucked liquid in ml (milliliters) as a function of time in seconds is shown by a dashed line. The curve 6 is the volumetric flow in ml/s as a function of time in seconds. Reference sign 7 shows the physiological vacuum curve of the baby, the vacuum being indicated in mmHg and the time likewise in seconds. Reference sign 8 designates the trigger threshold of the valve, which is preferably at 20 to 30 mmHg. As can be seen from FIG. 8, there is no flow of milk in the phases in which the absolute value of the vacuum generated by the baby is below this trigger threshold. These phases are designated by A in the figure. When the applied vacuum is sufficient to open the valve, milk then flows. These are the B phases. The teat unit therefore closes and opens cyclically with the feeding rhythm of the baby.

Figure 7:
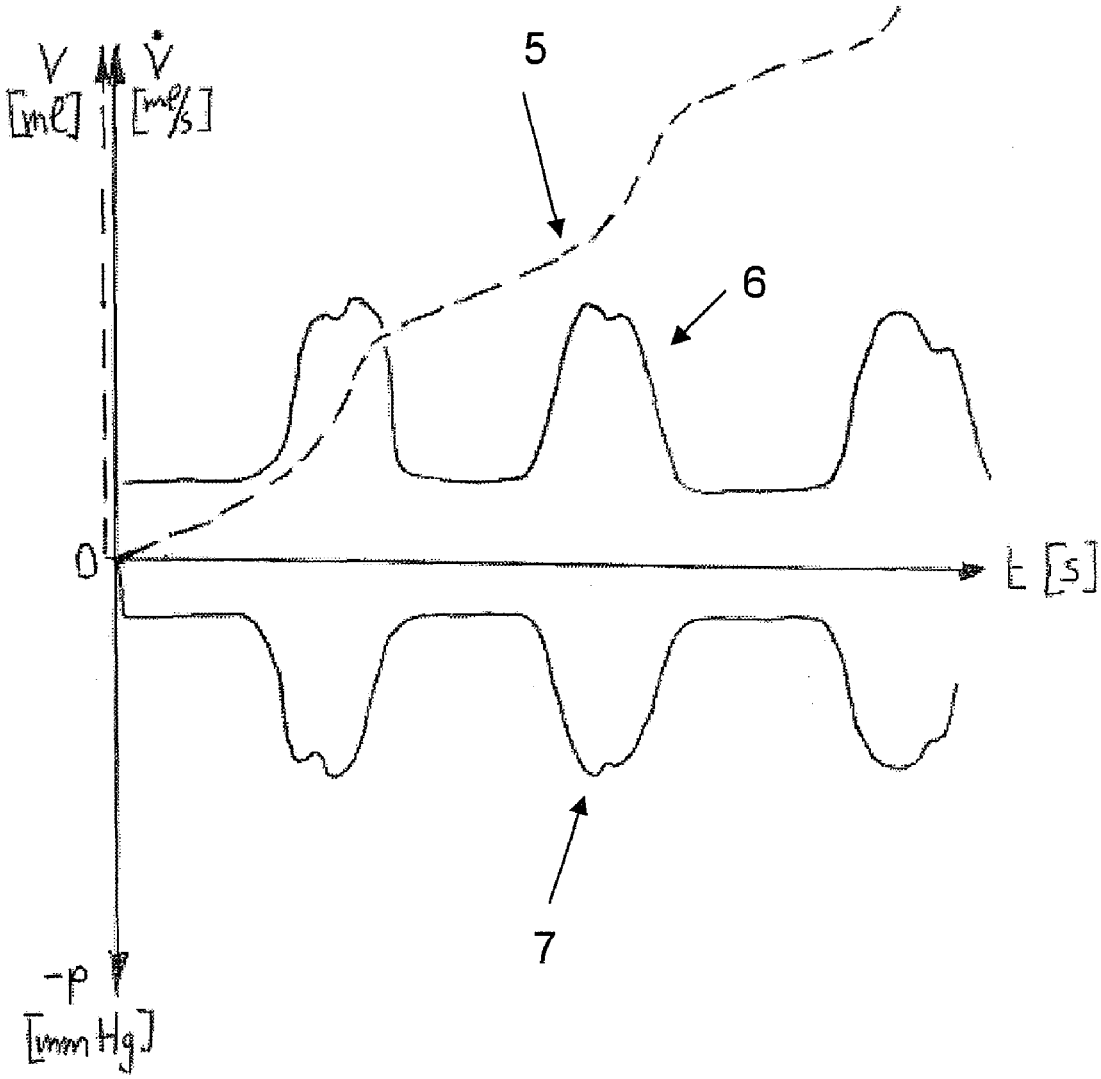
FIG. 7 shows a graphic representation of the mode of operation of a valve according to the prior art.

By contrast, FIG. 7 shows the behaviour of a teat unit according to the prior art. The same curves are provided with the same reference signs. The flow of milk is not interrupted, and a continuous flow of milk is generated. The baby is unable to take a rest between times and instead has to swallow milk continuously, even when maintaining only the basic vacuum. This does not correspond to the situation at the mother's breast.

Instead of the teat described above, other teats can also be used here. For example, the radially inwardly directed flange of the main body can be flush with the opening plane of the main body or can also be oriented at a downward angle from the opening of the main body.

Moreover, instead of the suction channel or the skirt, a differently shaped inner connecting means can also be present. For example, a suction channel can have a radially outwardly directed flange that engages behind a correspondingly shaped seat of the receiving unit, in particular of the receiving head.

The free end of the milk channel or suction channel does not necessarily have to protrude into the main body. It is also possible for the suction channel to terminate at the end of the mouthpiece directed towards the main body. This free end of the suction channel is in this case shaped in such a way that it permits a leaktight, preferably plug-in connection to the receiving unit, for example by provision of suitable sealing means on or in the suction channel. In particular, this end area of the suction channel can be designed as a cone that takes up the receiving unit with pretensioning.

For example, the mouthpiece and/or the suction channel can further be provided with internal structures, for example radial or axial grooves, ribs, indentations or knobs. The suction channel can also be provided on its outside with such internal structures. The outer and inner surfaces of the main body can also have a plane or structured design.

The mouthpiece can be designed with a double wall along its entire length, in which case the two walls extend at a distance from each other, and either they join each other in the area of the mouthpiece or the inner wall ends free. The inner wall thus forms the suction channel.

The mouthpiece and/or the suction channel can for example have a hollow cylindrical or frustoconical design on the inside and/or the outside. The chosen suction opening can be relatively large or small. The suction opening can in particular have approximately the same cross-sectional surface area as the suction channel along its entire length. The suction opening can also have a smaller cross-sectional surface area than the suction channel. These variants can be combined with one another in any desired manner.

The teat unit according to the invention permits a feeding action that is as true to nature as possible, since the mouthpiece can be deformed very considerably, without substantially impairing the flow restriction.

The invention claimed is:

1. A teat unit for sucking a liquid from a liquid container, wherein the teat unit comprises a teat and a flow restrictor with a through-opening, the teat comprising a mouthpiece, and a main body which is formed integrally on the mouthpiece and widens relative to the mouthpiece, wherein a suction opening is present in the mouthpiece and a one-way valve is arranged outside the mouthpiece, and wherein the flow restrictor is arranged in the one-way valve or in an area adjacent thereto, and wherein the flow restrictor defines a maximum flow of the liquid passing through the suction opening from the liquid container, the flow restrictor being arranged outside the mouthpiece and at a distance to the mouthpiece, and the suction opening having a greater cross-sectional surface area than that of the through-opening of the flow restrictor, and wherein at least one suction channel extends between the flow restrictor and the suction opening and has, along the entire length, a greater diameter than the flow restrictor.

2. The teat unit according to claim 1, wherein the teat unit has a receiving head for receiving the teat, and wherein the flow restrictor is arranged in the receiving head.

3. The teat unit according to claim 1, wherein the teat unit has a discharge opening which is arranged upstream of the flow restrictor in a direction of flow of the liquid to the suction opening and which has a greater diameter than the through-opening of the flow restrictor, and wherein the one-way valve closes or frees the discharge opening.

4. The teat unit according to claim 1, wherein the one-way valve is a diaphragm valve.

5. The teat unit according to claim 1, wherein the suction opening has approximately a same diameter as or a greater diameter than the at least one suction channel.

6. The teat unit according to claim 1, wherein the suction channel has a constriction at a distance from the suction opening.

7. The teat unit according to claim 1, wherein the suction opening and/or the suction channel extending in the mouthpiece has a diameter of about 3 to about 8 mm, and the through-opening of the flow restrictor has a diameter of about 0.2 to about 0.7 mm.

8. The teat unit according to claim 1, wherein the mouthpiece is designed with a single wall or a double wall.

9. The teat unit according to claim 1, wherein the mouthpiece becomes stiffer, either continuously or in stages, towards the main body from a free end comprising the suction opening.

10. A teat unit for sucking a liquid from a liquid container, wherein the teat unit comprises a teat and a flow restrictor with a through-opening, wherein the teat comprises a mouthpiece, and a main body which is formed integrally on the mouthpiece and widens relative to the mouthpiece, wherein a suction opening is present in the mouthpiece, and wherein the flow restrictor defines a maximum flow of the liquid passing through the suction opening from the liquid container, wherein the flow restrictor is arranged outside the mouthpiece and at a distance to the mouthpiece, and that the teat unit has a one-way valve which is arranged outside the mouthpiece and at a distance to the mouthpiece, wherein the flow restrictor is arranged in the one-way valve or in an area adjacent thereto, and wherein at least one suction channel extends between the flow restrictor and the suction opening and has, along its entire length, the same or a greater diameter than the flow restrictor.

11. The teat unit according to claim 1, wherein the cross-sectional surface area of the suction opening is more than 100 times larger than the cross-sectional surface area of the through opening.

12. The teat unit according to claim 1, wherein the flow restrictor is spaced from the mouthpiece in the main body, and wherein the flow restrictor is formed in the teat.

13. The teat unit according to claim 10, wherein the flow restrictor is spaced from the mouthpiece in the main body, and wherein the flow restrictor is formed in the teat.

14. The teat unit according to claim 1, wherein the flow restrictor is spaced from the mouthpiece in the main body, and wherein the flow restrictor is located in a part of the teat unit that is separate from the teat.

15. The teat unit according to claim 10, wherein the flow restrictor is spaced from the mouthpiece in the main body, and wherein the flow restrictor is located in a part of the teat unit that is separate from the teat.

* * * * *